US006868876B2

(12) United States Patent
Nobbe

(10) Patent No.: US 6,868,876 B2
(45) Date of Patent: Mar. 22, 2005

(54) DEVICE FOR BAGGING BULK MATERIAL

(75) Inventor: Ludger Nobbe, Hagen a. T.W. (DE)

(73) Assignee: Windmoeller & Hoelscher KG, Lengerich (DE)

( * ) Notice: Subject to any disclaimer, the term of this patent is extended or adjusted under 35 U.S.C. 154(b) by 0 days.

(21) Appl. No.: 10/450,715

(22) PCT Filed: Feb. 18, 2002

(86) PCT No.: PCT/EP02/01803

§ 371 (c)(1),
(2), (4) Date: Jun. 24, 2003

(87) PCT Pub. No.: WO02/070347

PCT Pub. Date: Sep. 12, 2002

(65) Prior Publication Data

US 2004/0071928 A1 Apr. 15, 2004

(30) Foreign Application Priority Data

Mar. 5, 2001 (DE) ..... 101 10 478
Apr. 9, 2001 (DE) ..... 101 17 770

(51) Int. Cl.[7] ..... B65B 1/04

(52) U.S. Cl. ..... 141/286; 141/59; 141/65; 141/67; 406/171; 406/168

(58) Field of Search ..... 141/57–81, 234, 141/98, 286, 346, 383, 384; 406/173, 168, 171, 172

(56) References Cited

U.S. PATENT DOCUMENTS

| | | | | |
|---|---|---|---|---|
| 2,580,581 A | * | 1/1952 | Niemitz | 406/156 |
| 2,659,521 A | | 11/1953 | Howle et al. | 226/70 |
| 3,724,755 A | * | 4/1973 | Diamond et al. | 239/693 |
| 4,614,213 A | | 9/1986 | Englin | 141/59 |
| 6,273,153 B1 | * | 8/2001 | Reinsch | 141/65 |

FOREIGN PATENT DOCUMENTS

| | | |
|---|---|---|
| GB | 2 167 734 | 6/1986 |
| WO | 97/38904 | 10/1997 |

* cited by examiner

*Primary Examiner*—Khoa D. Huynh
(74) *Attorney, Agent, or Firm*—Jacobson Holman PLLC

(57) ABSTRACT

A device for the sacking of bulk material having a product container for receiving bulk material, a filling funnel, and a dust filter. A separator, which is connected to the filling funnel via a connection line, is arranged upstream to the dust filter. Furthermore, the separator for the extracted bulk material is connected to the product container for returning extracted bulk material thereto.

11 Claims, 1 Drawing Sheet

Fig.
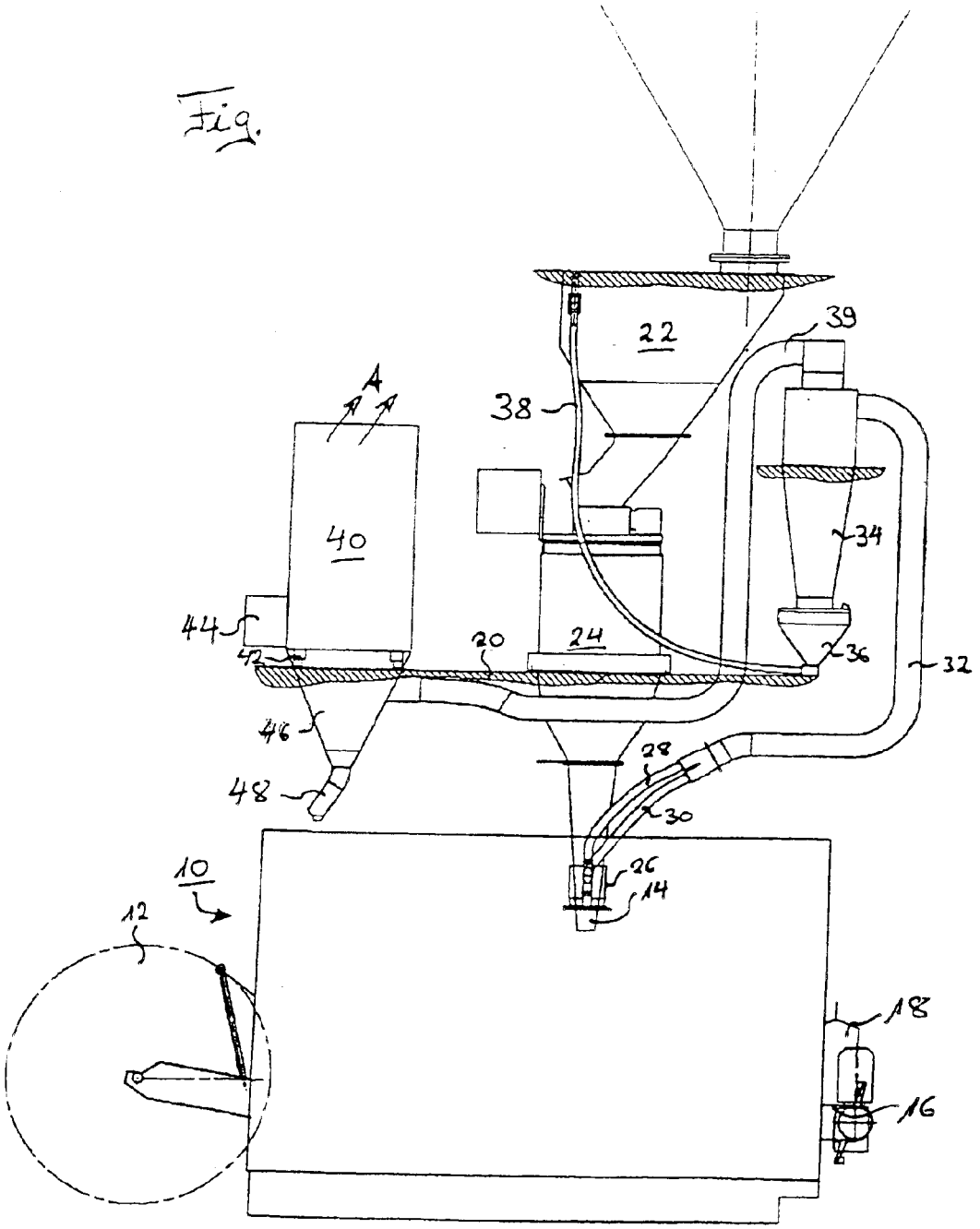

DEVICE FOR BAGGING BULK MATERIAL

This is a nationalization of PCT/EP02/01803 filed Feb. 18, 2002 and published in German.

BACKGROUND OF THE INVENTION

1. Field of the Invention

The invention relates to a device for the sacking of bulk material with a product container for receiving bulk material, a filling funnel and a dust filter.

2. Description of the Related Art

Devices for the sacking of bulk material are already known. In such sacking units, sacks made of tubular film are fed to a filling funnel, filled, closed, and led away on a runout conveyor. A product container is assigned to the filling funnel, in which the bulk material to be filled is received. Normally, a scale is also arranged between the product container and the filling funnel, which determines the quantity to be filled into the sack. Known sacking units provide an extraction system in the area of the scale, which serves the purpose of extracting dusty bulk material together with the ambient air, and to feed the same to a dust filter. These dust filters usually consist of depth filters, i.e. fiber filters that are often arranged in multiple layers on top of each other.

Due to the fact that the bulk material to be filled is often changed in such sacking units, various material is collected in the depth filter so that usually no authentic material is present after cleaning the dust filter, which can be re-fed to the products to be filled. The solids extracted during the periodic cleaning of the dust filter must therefore be discarded on a regular basis in such known sacking units.

SUMMARY OF THE INVENTION

It is the task of the present invention to embody a sacking unit for bulk material with a product container for receiving bulk material, a filling funnel and a dust filter, in which the bulk material portion extracted during the sacking process can be regained at least for the most part.

This task is solved according to the present invention by means of a sacking unit having an additional separating element.

Accordingly, in a device for the sacking for bulk material with a product container for receiving the bulk material, a filling funnel, and a dust filter, a separator is arranged upstream to the dust filter, which is connected to the filling tunnel by means of a suction line. The separator is then preferably connected to the product container by means of a conveyor line for the extracted bulk material.

According to this solution, the dust created during the filling of bulk material in the area of the pouring funnel is gathered immediately, and fed to a separator via the suction line, which according to a particularly advantageous embodiment of the invention may be a cyclone. The proportion of coarse solids is intercepted in the separator, while the proportion of fine solids is fed together with the air to the dust filter for the interception in the depth filters contained therein. The intercepted bulk material is fed from the separator back to the product container via a conveyor line, where the authentic material may be added to the bulk material to be filled.

Additional advantages of the present invention are apparent as set forth more fully hereinafter, including the embodiment example described as follows, and in the only figure.

BRIEF DESCRIPTION OF THE DRAWING

The FIGURE schematically shows a sacking unit.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The sacking unit, which is conventionally constructed, is generally equipped with the reference number 10. Here, tubes are separated from a tubular film roll 12 in a manner not explained in further detail, which are sealed at one end in order to form a sack. The respective sacks are hung underneath a filling funnel 14 for the filling with bulk material. After the filling, the sacks 18 are sealed at a sealing station, and subsequently led away via a runout conveyor 16. The filling funnel 14 is an integral part of the sacking unit 10. A product container 22 for receiving the bulk material to be filled is arranged over the filling funnel. From there, the bulk material is fed to the filling funnel for the filling of sacks 18 not illustrated in detail via a scale 24.

A suction hood 26 is arranged on the filling funnel 14 above the area where the sacks 18 are hung. Suction lines 28 and 30 connect to the suction hood 26, which end in a mutual line 32. The line 32 extends tangentially into a cyclone 34, which has an intercepting tank 36 for receiving the extracted bulk material. From this intercepting tank 36, a supply line 38 for the extracted bulk material extends to the product container 22. The extracted authentic bulk material can be fed to the product container 22 via this supply line.

A suction line 39 is connected at the upper end of the cyclone 34, which feeds the supply air, and the not-extracted proportion of fine solids of the bulk material to a dust filter 40. The dust filter is elevated on the platform 20 via feet 42. Several filter layers are arranged on top of each other in the dust filter. The purified air flows into the direction of arrow A from the dust filter, while the proportion of fine solids of the bulk material is retained in the filter pads.

In order to be able to clean the filter pads, a vibrating motor 44 is attached to the dust filter 40, which actuates the entire dust filter into vibrating motions so that the extracted dust partially falls into a funnel 46 that is attached underneath the dust filter, from which this waste material can be extracted via a waste material outlet 48. Due to the fact that the filter pads of the dust filter 40 should not be exchanged with each product change, it cannot be prevented for various different products to get into the funnel 46 during the vibrating motion of the dust filter 40 so that the extracted material cannot be fed to the product container 22.

This illustrated embodiment example describes a cyclone 34 as a pre-separator. Depending on the product specification of the bulk material, however, other separators, such as deflection separators, etc. are also suitable as pre-separators.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A device for sacking bulk material, comprising:

a product container for receiving bulk material and providing said bulk material to a filling funnel having an outlet through which said bulk material is directed into sacks positioned beneath said funnel;

a dust filter for collecting bulk material dust that is entrained in ambient air collected from a region adjacent said outlet of said filling funnel; and a separator located upstream of said dust filter and downstream of said product container and being connected to said filling funnel via a first suction line for collecting said bulk material dust that is entrained in ambient air in said region while the bulk material passing through said funnel outlet is directed into sacks, said separator recovering a portion of bulk material from said entrained bulk material dust and returning said recovered portion to said product container through a supply line connected to a lower end of said separator, fine dust solids that are not recovered from said entrained bulk material dust being directed from said separator to said dust filter through a second suction line connected to an upper end of said separator.

2. The device according to claim 1, wherein said separator is a cyclone.

3. The device according to claim 1, wherein a scale for weighing of the bulk material is arranged between the product container and the filling funnel.

4. The device according to claim 1, wherein the dust filter is a depth filter.

5. The device according to claim 1, wherein the dust filter has a vibrating motor for rough cleaning of extracted bulk material.

6. A device for sacking bulk material, comprising:

a sacking unit associated with a tubular film roll from which tubes are separated and sealed at one end to form sacks, said sacking unit including a filling funnel with an outlet which the sacks are hung beneath for filling with bulk material;

a product container arranged over said filling funnel for receiving the bulk material;

a separator connected to said filling funnel via a first suction line for collecting bulk material dust that is entrained in ambient air while the bulk material is directed through said funnel and into said sacks, said separator recovering a portion of bulk material from said entrained bulk material dust and returning said recovered portion to said product container through a supply line connected to a lower end of said separator; and a dust filter connected to said separator by a second suction line connected to an upper end of said separator, said dust filter receiving bulk material dust from said separator.

7. The device according to claim 6, further comprising a suction hood arranged on said filling funnel above an area where said sacks are hung, said first suction line connected to said filling funnel via said suction hood.

8. The device according to claim 6, wherein said separator is a cyclone.

9. The device according to claim 8, wherein said first suction line is connected to said upper end of said cyclone.

10. The device according to claim 9, wherein said cyclone includes an intercepting tank for receiving the recovered portion of bulk material, said supply line being connected to said intercepting tank.

11. The device according to claim 6, further comprising a conveyor arranged at an outlet of said sacking unit for leading away the sacks filled therein.

* * * * *